US005791794A

United States Patent [19]

Kopp et al.

[11] Patent Number: 5,791,794

[45] Date of Patent: Aug. 11, 1998

[54] TRANSFER PRINTING STATION FOR PARALLEL PROCESSING OF TWO RECORDING MEDIUM WEBS

[75] Inventors: Walter Kopp, Taufkirchen; Ernst Puritscher, Unterhaching; Gerhard Klapettek, Giessen, all of Germany

[73] Assignee: Siemens Nixdorf Informationssysteme Aktiengesellschaft, Paderborn, Germany

[21] Appl. No.: 776,252

[22] PCT Filed: Jul. 21, 1995

[86] PCT No.: PCT/DE95/00967

§ 371 Date: Jan. 22, 1997

§ 102(e) Date: Jan. 22, 1997

[87] PCT Pub. No.: WO96/03282

PCT Pub. Date: Feb. 8, 1996

[30] Foreign Application Priority Data

Jul. 22, 1994 [DE] Germany ..... 44 26 124.1

[51] Int. Cl.[6] ..... B41J 11/50

[52] U.S. Cl. ..... 400/584; 400/616; 400/616.2

[58] Field of Search ..... 400/611, 616, 400/616.1, 616.2, 619, 584, 585

[56] References Cited

U.S. PATENT DOCUMENTS 4,974,979 12/1990 Cardenas .

FOREIGN PATENT DOCUMENTS 0 050 718 5/1982 European Pat. Off. .
32 11 492 12/1982 Germany .

OTHER PUBLICATIONS

K. Sanders, "Two–Path Electrophotographic Print Process", IBM Technical Disclosure Bulletin, vol. 22, No. 6, Nov. 1979.

*Primary Examiner*—John S. Hilten
*Attorney, Agent, or Firm*—Hill & Simpson

[57] ABSTRACT

A printing station includes pins for engaging into edge perforations of continuous paper. The pins are mounted on a toothed belt at the gaps between the belt teeth. A two part pin mounting has a portion engaged between the teeth of the belt.

12 Claims, 8 Drawing Sheets

TRANSFER PRINTING STATION FOR PARALLEL PROCESSING OF TWO RECORDING MEDIUM WEBS

BACKGROUND OF THE INVENTION

1. Field of the Invention

The present invention relates generally to a paper transport for a printer station, and in particularly to a pin construction for engaging perforations along edges of continuous paper.

2. Description of the Related Art

It is standard to employ what is referred to as a tractor drive for the transport of margin-perforated recording media in the region of the transfer printing station of electrographic printer devices. Such a tractor drive is disclosed, for example, by German patent document DE-C2-3307583. The known tractor drive contains a toothed belt that runs over a drive pulley and a deflection pulley. Dog pins that engage into the margin perforations of the recording medium for transporting the band-shaped recording medium are mounted laterally at the toothed belt via holders.

So that the dog pins can easily enter into the perforation holes and slide therefrom in turn during the rotation of the pulleys, it was also proposed according to the illustration of FIG. 2 to guide the recording medium 10 under the neutral fiber 30 of the belt 26.

An electrographic printer device disclosed in the earlier European Patent Application 93108219.2 is designed for printing band-shaped recording media with different band widths in different operating modes such as single-color and multicolor simplex printing, single-color and multicolor duplex printing and for simultaneously printing two recording medium webs in parallel operation. To this end, the units of the printer device such as an intermediate carrier, a transfer printing station and fixing station have a usable width of at least twice the band width of a narrow recording medium. The printer device also contains a deflection means that follows the fixing station, that can be connected in as needed and that has an allocated return channel to the transfer printing station via which the recording medium media can be turned over in single-color or multicolor duplex mode and resupplied to the transfer printing station.

Due to the employment of two recording medium webs in the parallel operation, two tractor drives must be arranged parallel next to one another in the region of the transfer printing station. Since the transfer printing region, including the transfer corotron, extends continuously over two recording medium webs, it is necessary to keep the unusable gap between the recording medium webs and, thus, between the tractor drives optimally small. A lateral arrangement of the dog pins next to the belt according to the illustration of FIG. 2 would enlarge the gap.

When, according to the illustration of FIG. 3, however, the dog pins are arranged on the outer circumferential surface of the belt, the recording medium is at a great distance from the neutral fiber. The spacing of the dog pins thus varies considerably when rolling over the pulley, this leading to damage to the perforation holes.

European patent document EP-A2-0 391 693 discloses a tractor drive with a toothed belt having pins centrally arranged thereon for a margin-perforated recording medium in an impact printer via which a single recording medium web is conveyed through the printer. A ramp that lowers the toothed belt and, thus, the pins comprising a collar and a conically tapering tip relative to the recording medium before the pulley is arranged between the actual transport region and a pulley that drives the toothed belt. Upon rotation around the pulley, the pins thus glide from the transport holes without damaging them.

In electrographic continuous printers, tractor drives serve the purpose of conducting the paper web with tangential contact via a transfer printing saddle to a photoconductive drum in order to transfer toner images from the photoconductive drum onto the paper web in the transfer printing region. To this end, the paper web lies taut against the photoconductive drum at the location of the transfer printing. The paper web is conveyed with feed crawlers arranged preceding and following the transfer printing saddle.

Continuous stock for electrographic continuous printers are provided with transport holes in the margin regions into which dog pins (transport pins) engage in order to transport the paper with positive lock.

When the spacing from pin to pin is different, then the paper web is correspondingly placed incorrectly on the photoconductor in the transfer printing zone. The position of the paper does not coincide with the position of the print format on the photoconductor; the print format is transferred onto the paper positionally offset.

This positional imprecision in paper running direction of the toner image on the paper is also referred to as line alignment error.

Higher and higher demands are made of the transfer precision of the toner image onto the paper in order, for example, to obtain a clean superimposition of a plurality of print formats on top of one another (full-color printing). A possibility must therefore be found for arranging the pins correspondingly precisely, with the minutest possible division errors relative to one another.

A further problem arises when different tensile stresses across the width of the paper web occur in the paper web after the paper transport, caused, for example, by a skewed running of the paper in the fixing station. The paper then tends to form ripples under the covers of the feed crawlers. The ripple of the paper web cannot propagate in the direction of the support (paper baffle) since this acts in supporting fashion against the paper web but only in the direction of the closed feed crawler cover; it attempts to lift the latter up. The paper perforations work in the direction of the tip of the dog pins and thus deviate from their rated position, which is prescribed by the symmetry axis of the dog pins. Line and column alignment errors are the consequence.

Caused by tensile forces and fluctuations in tensile force in the paper web, these forces act on the dog pins. Since the dog pins in the tractor drive disclosed by German patent document DE-C2-3307583 lie next to the toothed belt but are mounted on the belt with a pin clamp, a torque on the clamps arises. Dependent on the paper traction forces, this torque causes a more or less pronounced slanting of the pin clamps. Corresponding errors in the paper position relative to the ideal, zero position and, thus, line alignment errors are the consequence.

When accelerating the paper web during a startup event, the pin clamps are prestressed and, thus, pitched due to the inert mass of the paper web. After the end of the acceleration event, the pin clamps in turn relax in the form of oscillatory event. This relaxation oscillatory event is still visible as a line alignment error is the print format about 10 to 15 lines after the acceleration event.

It is possible that paper jams can occur in the feed crawlers due to unfavorable paper properties such as, for example, damage to the paper. These paper jams result therein that an extremely large bending moment is transmitted onto the individual clamps and this can lead to breakage of the clamps. This bending moment is generated in that the dog pins (transport pins) lie next to the conveyor belt and the clamps can thus pitch under load.

SUMMARY OF THE INVENTION

It is therefore an object of the invention to provide a transfer printing station for an electrographic printer device that makes it possible to convey two parallel recording medium webs composed of recording media provided with margin perforations arranged in close proximity next to one another through the transfer printing station and print them in parallel. The transfer printing station should thereby be able to reliably process recording media of different tearing resistance with high line alignment precision.

This object is achieved by a transfer printing station for an electrographic printer or copier device, with two recording medium webs comprising margin perforations conducted over a transfer printing saddle in close proximity next to one another, a conveyor means for the parallel transport of the recording medium webs at least in the region of a transfer printing saddle, toothed belts respectively allocated to the margin perforations of the recording medium webs that are guided over axially spaced, motor-driven toothed disks, and dog pins centrally secured on the outside circumferential surface of the toothed belts, said dog pins comprising a collar with guide surfaces which is adjoined by a tapering head part and that engage into the margin perforations up to the collar in a conveying path lying between the toothed disks and convey the parallel recording medium webs, whereby, for achieving a high line alignment precision, the motor-driven, endless toothed belts comprise transport teeth on their inside circumferential surface that are arranged in a predetermined tooth division based on the spacing of the margin perforations of the recording medium webs having a division error from tooth to tooth or, respectively, gap to gap that is a fraction of the required line alignment precision and comprise dog pins mounted on their outside circumferential surface dependent on the tooth division of the transport teeth.

Advantageous developments of the invention are provided by having dog pins that are respectively arranged in a base member on the outside circumferential surface of the toothed belt, whereby the base member has an adjustment element allocated to it that engages into gaps limited by tooth profiles of the transport teeth and thus adjusts the base member.

The transfer printing station has an adjustment element that is fashioned as a catch element latched to the base member. An adjustment element attach at the tooth profiles of the transport teeth via adjustment bevels.

The catch element preferably comprises a clamp web that is guided by a gap and has seating nipples, or ridges, that are arranged such that the catch element supports itself line-shaped with maximum base in the gap.

A base member is provided that accepts the dog pins and that comprises spacer webs to a base member at at least one side in the contacting region to a base member lying alongside. The base members that accept the dog pins and that comprise positioning means that are fashioned such that the base members can only be arranged on the toothed belt in a defined integration position next to one another. The base member that accept the dog pins preferably comprises a recess on the one side and a mounting nose on the other side in the contacting region to the base members lying alongside.

In one embodiment, the dog pins have a collar with conical guide surfaces tapering in the direction of a seating surface for the recording medium, a head part adjoining the collar, whereby the dog pins engage into the margin perforations of the recording medium up into the region of their collars upon transport of the recording medium, and the guide surfaces generate a force component in the contact region to the recording medium that presses the recording medium against the seating surface.

The transfer printing station has at least one pulley over which the toothed belt is conducted, and a recording medium positioning device arranged in the region of the pulley that guides the recording medium upon engagement and disengagement of the dog pins during the rotation of the pulley in the region of the head part of the dog pins such that the margin perforations are not deformed. In addition, a guide element that lifts the recording medium in the region of the pulley is provided.

A supporting means is included that supports the toothed belt in a conveying region between the pulleys and that has allocated hold-down elements for the recording medium.

The inventive transfer printing station comprises two recording medium webs comprising margin perforations that are arranged in close proximity next to one another in parallel tractor drives and conducted parallel and synchronously over the transfer printing saddle with the assistance of the tractor drives. The margin perforations of the recording medium webs are respectively allocated to motor-driven toothed belts that comprise dog pins centrally mounted on their outside circumferential surface via clamps, the dog pins comprising a collar containing guide surfaces and a tapering head part.

Two parallel recording medium webs can thus be simultaneously printed.

Given the tractor drive arranged in the transfer printing station, the dog pins are positioned on the toothed belt on the outside circumferential surface of the toothed belt dependent on the tooth division of the toothed belt. To this end, a toothed belt having extremely small division errors from tooth to tooth or, respectively, gap to gap is employed with a precision that is only a fraction of the required line alignment precision. The dog pins are centrally secured on the toothed belt via pin clamps.

A pin clamp carrying a single dog pin can be composed of two parts. The one part is the base member of the pin clamp on which the transport pin is seated cast into the base member. The second part is the clamp web of the pin clamp. The clamp web of the pin clamp is placed in the gap of the toothed belt and the base member of the pin clamp is latched to the clamp web of the pin clamp. The two legs of the clamp web, which are implemented as hooks, snap interlocking into the corresponding counterpart of the base member with a prestress. The division centering is achieved by the position of the clamp web in the gap of the belt.

The edge of the clamp web facing toward the tooth faces of the belt comprise a bevel that corresponds to the shape of the tooth face of the belt. As a result of its prestress, the clamp web thus centers itself in the toothed belt gap.

Since the clamp web is slightly bent by the prestress, it is advantageous to allow the clamp web to only center line-like with a maximum base in the gap in order to thus avoid an undefined position of the clamp web in the gap and, thus, a faulty division of the transport pins.

In order to avoid division errors of the transport pins that occur, for example, due to tolerances in the manufacture, the base member that accepts the dog pins comprises positioning means that are fashioned such that the base members can only be arranged next to one another on the toothed belt in a defined integration position.

These positioning means can be composed of a recess and of a mounting nose interacting therewith that are arranged at both sides of the pin clamp.

As a result of the clamp recess, the clamps only lie against one another on a very short base via webs in the edge regions; the middle region is free. Paper dust and other dirt can thus fall out between the clamps without being pressed between the clamps. Tooth division imprecisions as a result of dirt pressed between the clamps can therefore not occur.

A further advantage is the employment of conical pin guide surfaces in the region of the pin collar. A force component that presses the paper web against a seating surface in the region of the margin perforations is thus generated via the conveying force of the paper web. The paper web can therefore not migrate up, for example against the feed crawler cover. This enables a positionally exact, stable paper running.

This clamp design is of considerable advantage in a continuous stock duplex data printer with two recording carrier webs lying next to one another in close proximity in parallel operation. With the inventive clamp design, thus, two paper webs running side-by-side can be operated minimally close to one another. Given this clamp design, however, it is beneficial to lift the paper web before the disengagement or, respectively, before the engagement of the pins from or, respectively, into the transport perforations in order to thus avoid a tearing of the transport perforations. The lifting of the paper web can be achieved by a corresponding shaping of the paper baffle.

This ramp-like shaping of the paper baffle, however, generates a force component in the paper web that presses it against the feed crawler cover. Paper running problems and line alignment errors of the print format are the consequence.

The conical guide surface shape of the transport pins likewise prevents this disturbing effect.

Given known tractor drives employed in electrographic continuous printers, the dog pins are arranged in clamps that lie next to the belt. Since the paper web has a resistance to the conveying direction, the pin clamps are placed pitched given this torque load. As a result thereof, the paper web—whose position is defined by the transport pins—deviates from the required rated position. The toner image is then transferred onto the paper web positionally offset in the transfer printing zone. Line alignment errors are the consequence.

The inventive clamps are implemented such that they lie centrally on the outside circumferential surfaces of the belts. A tilting moment can thus not occur. Since the clamps cannot pitch, the position of the transport pins is independent of fluctuating in the conveying load of the paper web.

Due to the above-described slanted positioning of the known transport clamps, the individual clamp is so highly stressed by the torque occurring in case of a paper jam and that acts on the clamp member as a bending moment that a clamp breakage can occur.

The inventive clamp has the transport pin arranged such that this lies centrally on the conveyor belt. The force transmission from the transport pin to the conveyor belt thus ensues without a lever arm. As a result, no bending moment is transmitted onto the clamp. A risk of destroying the transport clamps given a paper jam is thus no longer present.

BRIEF DESCRIPTION OF THE DRAWINGS

Embodiments of the invention are shown in the drawings and are described in greater detail below. Shown are.

DETAILED DESCRIPTION OF THE PREFERRED EMBODIMENTS

Figure 1:
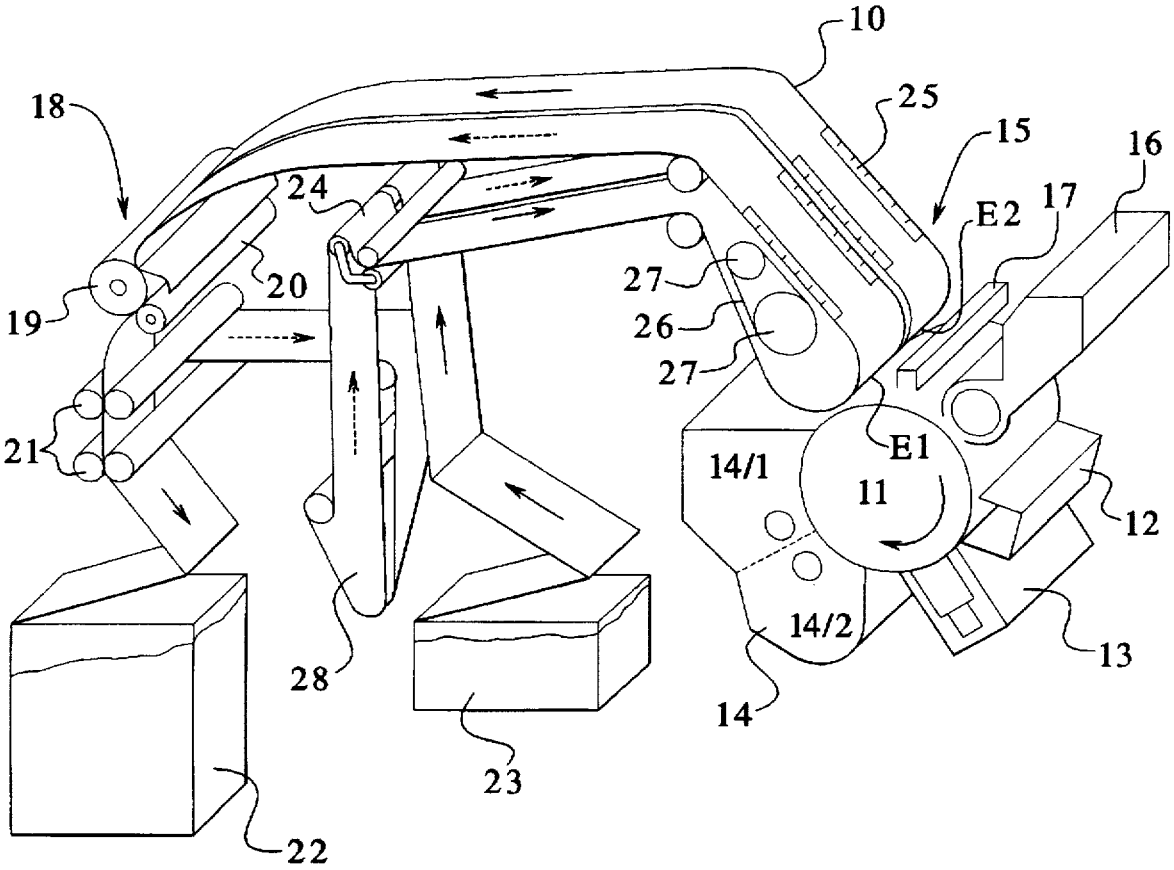
FIG. 1 is a schematic perspective illustration of an electrographic printer device with two recording medium webs with tractor drive arranged in close proximity next to one another in the region of the transfer printing station.

An electrographic printer device for printing band-shaped recording media 10 with different band widths contains an electromotively driven photoconductor drum as an intermediate carrier 11. Instead of the photoconductor drum, however, a band-shaped intermediate carrier, for example an OPC band, or a magneto-styli arrangement as disclosed, for example, by European patent document EP-B1-0 191 521 can also be employed. The various units for the electrophotographic process are grouped around the intermediate carrier 11. These are essentially: a charging means 12 in the form of a charging corotron for charging the intermediate carrier; a character generator 13 with a light-emitting diode comb for the character-dependent exposure of the intermediate carrier 11 that extends over the entire usable width of the intermediate carrier 11; a developer station 14 for inking the character-dependent charge image on the intermediate carrier 11 with the assistance of a one-component or two-component developer mixture; a transfer printing station 15 that extends over the width of the intermediate carrier 11 and with which the toner images are transferred onto the recording medium 10. A cleaning station 16 with cleaning brush integrated therein with appertaining extraction means as well as a discharge means 17 is provided for removing the residual toner after the developing and the transfer printing. The intermediate carrier 11 is electromotively driven and is moved in the direction of the arrow during printing mode.

The printer device also contains a fixing station following the transfer printing station 15 in the conveying direction of the recording medium, this fixing station 18 being fashioned as a thermoprinting fixing station having a heated fixing drum 19 with an appertaining pressure drum 20 as well as guide rollers 21 following the fixing station that, among other things, serve as output elements for a stacker means 22 for the recording medium 10. Other fixing stations, for example with a heated or unheated admission saddle or a cold fixing station are also possible instead of the illustrated fixing station. The band-shaped recording medium 10 is fabricated as pre-folded continuous stock provided with margin perforations and is supplied to the transfer printing station via delivery rollers 24 proceeding from a supply region 23.

The transport of the recording medium thereby preferably ensues via a conveyor means 25 allocated to the transfer printing station in the form of conveyor belts 26 provided with pins 32 that, guided over pulleys in the form of toothed disks 27, engage into the margin perforations 31 of the recording medium 10. Further, a deflection means 28 via which the recording medium 10 is returned from the fixing station 18 to the transfer printing station 15 is arranged in the housing region of the printer device between supply region 23 and the fixing station 8.

The electrographic printer device is suitable for printing recording media having different band widths. To this end, the intermediate carrier 11 (photoconductor drum) comprises a usable width that corresponds to the greatest possible recording medium width (for example, a format of DIN A3 crosswise). This width corresponds to twice the DIN A4 band width. It is thus possible to arrange two recording medium webs E1 and E2 with a width corresponding to DIN A4 longitudinally next to one another in the region of the transfer printing station 15. The fixing station 18 and the other electrophotographic units such as developer station 14, character generator 13, cleaning station 16 are designed according to this usable width.

An adaptation of the width of the character generator 13 to different recording medium widths requires no mechanical modification at the character generator when, as in this case, an LED character generator having a plurality of LEDs arranged in rows is employed. An adaptation to the width of the recording medium employed ensues electronically by drive.

Figure 2:
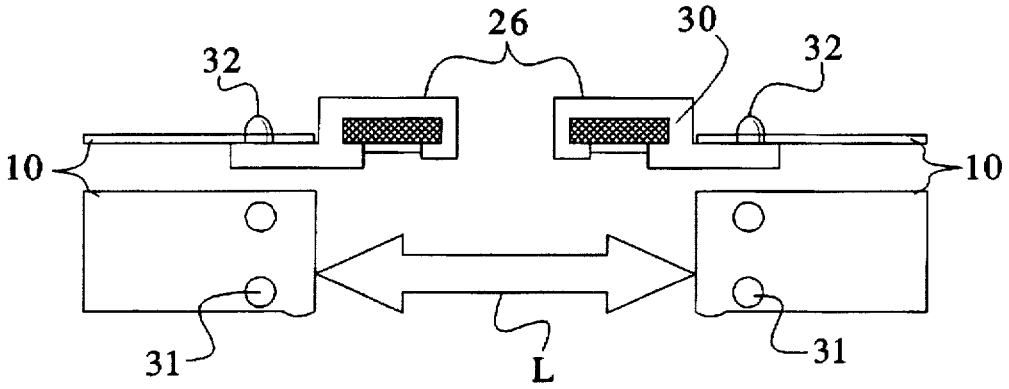
FIG. 2 is a schematic end illustration of a known tractor drive with dog pins guided next to the belt.

In FIG. 2, as a result of employing two recording medium webs E1 and E2 in parallel operation, two tractor drives 25 must be arranged parallel next to one another in the region of the transfer printing station 15. Since the transfer printing region 15—including the transfer corotron—extends continuously over the two recording medium webs E1 and E2, it is necessary to keep the unusable gap L between the recording medium webs E1 and E2 and, thus, between the tractor drives as small as possible. A lateral arrangement of the dog pins 32 next to the belt 26 corresponding to the illustration of FIG. 2 would enlarge the gap L.

Figure 3:
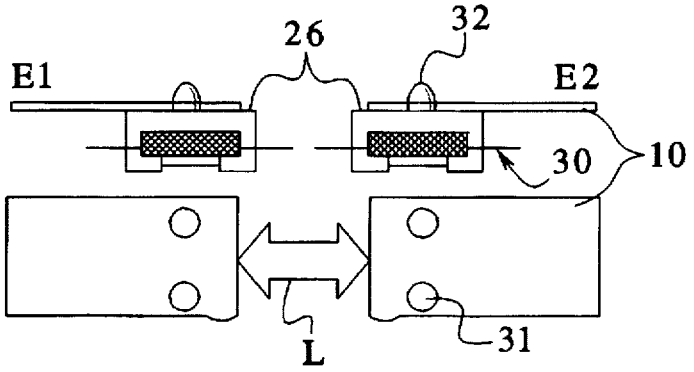
FIG. 3 is a schematic end illustration of a tractor drive with dog pins arranged on the outside surface of the belt.

When, however, the dog pins are arranged on the outer circumferential surface of the belt 26, corresponding to the illustration of FIG. 3, then the recording medium 10 is at a considerable distance from the neutral fiber 30. The spacing of the dog pins thus varies considerably when rolling over the pulley 27, which leads to damage to the perforation holes. The dog pins 32 are thereby composed of steel. They have a cylindrical collar 33 which is joined by a tapering head part 34. The recording medium 10 is conveyed via the cylindrical collar 33. The tapering head part 34 serves as a threading element.

Figure 4:
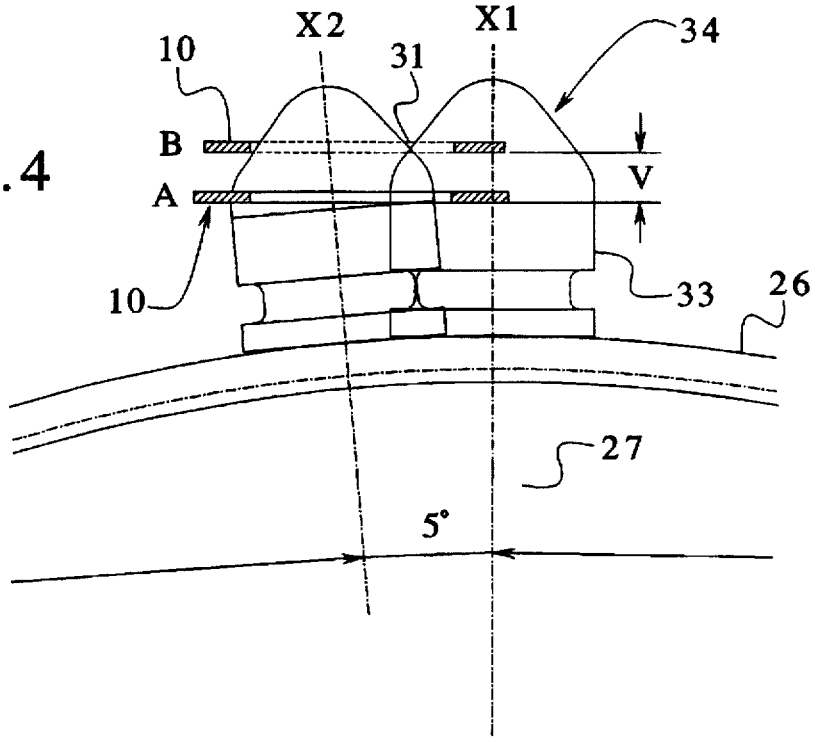
FIG. 4 is an enlarged side illustration of the effect of a lifting of the recording medium in the region of the pulleys.

In order to avoid this widening or, respectively, stretching of the perforation holes 31 that has a very negative effect on the paper running, the recording medium 10 is shifted or, respectively, lifted to such an extent from the transport position A in the region of the pulley 27 that, corresponding to the illustration of FIG. 4, the perforation holes 31 are located in a roll-off position B in the region of the tapering head part 34. The size of the displacement V is dependent on, among other things, the radius of the pulley 27, the thickness of the belt and the transport attitude of the recording medium. It is to be adapted such dependent on these parameters that the perforation holes glide along the pin walls at a slight distance therefrom when the pins engage and disengage during the roll-off event without having a significant pressure force acting against the perforation wall. In FIG. 4, X1 indicates the position of the pin 32 in an initial position and X2 indicates the position of the pin 32 after a revolution of the pulley 27 by 5 degrees. It can be seen therefrom that the collar 33 would deform the wall without upward displacement of the perforation hole 31.

The actual propulsion for the recording medium ensues in the straight conveying region of the pin guidance between the pulleys. The pins should be able to glide freely in the perforation holes in the region of the pulleys themselves.

Figure 5:
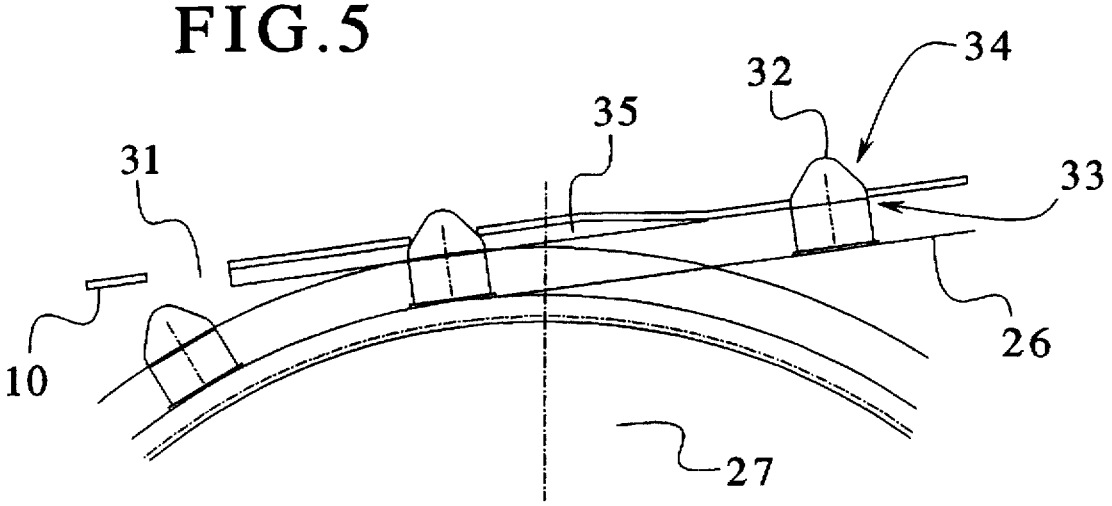
FIG. 5 is a schematic side, excerpted view of a guide element that lifts the recording medium in the region of the pulleys.
Figure 6:
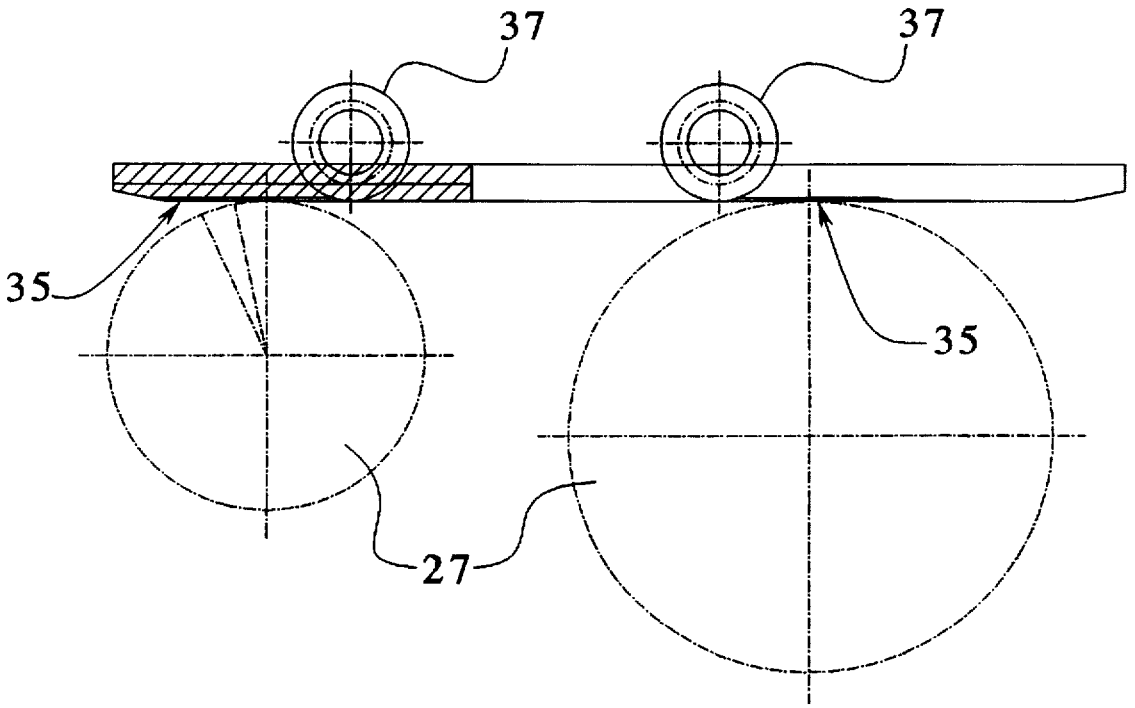
FIG. 6 is a schematic illustration of a tractor drive with guide elements.

In order to undertake the lifting of the recording medium 10 in a simple way, a paper guide element 35 is arranged in the region of the pulleys according to FIGS. 5 and 6. This paper guide element 35 extends into the straight region (conveying distance) of the pin guidance and lifts the recording medium by, for example, approximately 1 mm. A supporting means in the form, for example, of a hold-down means that supports the belt 26 in the conveying region between the pulleys 27 comprises hold-down elements 37 for the recording medium 10 preceding and following the paper guide element 35. These can be composed of rollers or of baffles or the like.

In the exemplary embodiments of FIGS. 7 through 14, the drive of the dog pins 32 (pins) ensues via a motor-driven, endless toothed belt 26 that comprises transport teeth 39 on its inside circumferential surface that are arranged in a predetermined tooth division based on the spacing of the margin perforations 31 of the recording medium 10. What is to be understood by this is that the transport teeth 39 have a predetermined, uniform spacing from one another that is in turn dependent on the given, standardized spacing of the margin perforations 31 of the recording medium 10. For example, this means that, for example, two transport teeth are provided per margin perforation spacing. The toothed belt 26 is fashioned, for example, as a fiberglass reinforced toothed belt on which the dog pins 32 are secured via plastic clamps 38 (pin clamps) that embrace the belt 10. Gaps 40 open up between the transport teeth 39. These are limited by the slanting tooth profiles 41 of the transport teeth. Given uniformly spaced transport teeth, the tooth division is also defined by the number of gaps per unit of length (for example, margin perforation spacing). The toothed belts are fabricated with such precision that the division errors from tooth to tooth are extremely slight. A precision that is only a fraction of the required line alignment precision. For this reason, the dog pins 32 on the outside circumferential surface of the toothed belt 26 are adjusted dependent on the tooth division.

In order to enable this positioning of the dog pins 32 (pins) dependent on the tooth division, each individual pin clamp 38 carrying a dog pin 32 is composed of two parts according to the illustrations of FIGS. 7 through 10. The one part is the base member 42 of the pin clamp on which the dog pin 32, cast into the base member 42, is seated. The second part is the clamp web 43 of the pin clamp. The clamp web 43 of the pin clamp is placed into the gap 40 of the toothed belt 26 and the base member 42 of the pin clamp is latched onto the clamp web 43 of the pin clamp. The two legs of the clamp web 43, which are implemented as hooks 44 (FIG. 8), snap positively locked into the corresponding counterpart 45 of the base member 42 with a prestress. The division centering is achieved by the position of the clamp web 43 in the gap 40 of the belt.

The edges of the clamp web facing toward the tooth profiles 41 of the belt 26 comprise a bevel 46 (adjustment bevel) that corresponds to the shape of the tooth profile of the belt 26. The clamp web 43 thus centers itself in the gap 40 due to its prestress.

Figure 8:
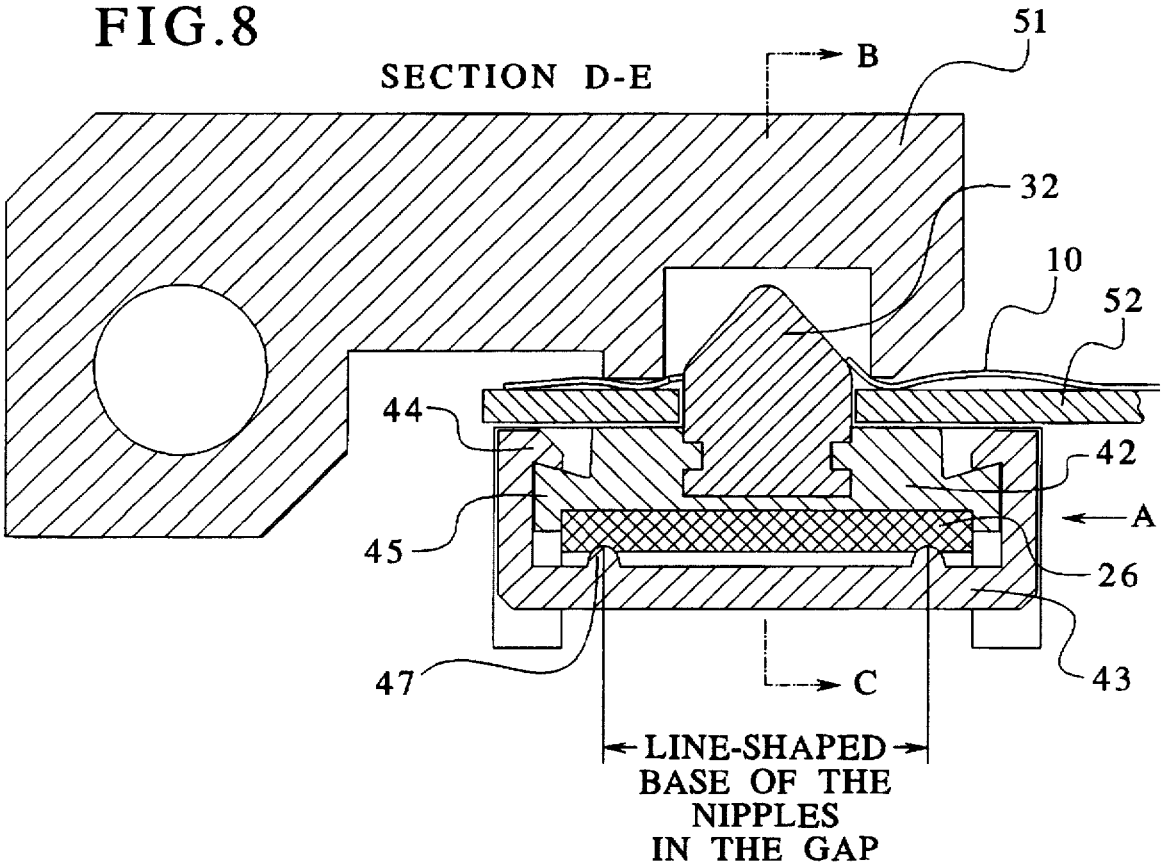
FIG. 8 is a schematic enlarged crossectional view of a tractor drive with centrally arranged pin clamps and dog pins with cylindrical collar.
Figure 9:
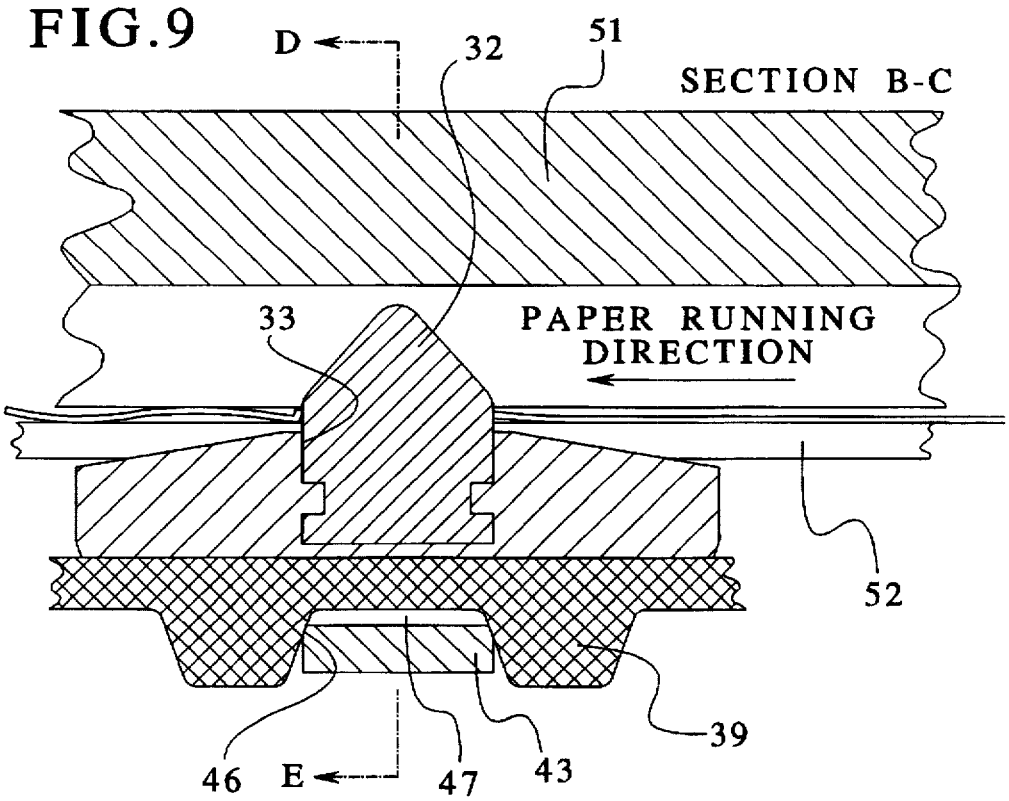
FIG. 9 is a schematic enlarged crossectional view of the tractor drive of FIG. 8 along the section line B–C.

Since the clamp web 43 is slightly bent by the prestress, it is beneficial to allow the clamp web 43 to only center in the gap 40 line-shaped with a maximum base (FIGS. 8, 9). The line-shaped seating is achieved by seating nipples or ridges 47 provided at the clamp web 43. If this line-shaped seating were not provided, an undefined position of the clamp web 43 in the gap 40 and, thus, an incorrect division of the dog pins 32 would arise.

Instead of the clamp webs, it is also possible to provide lateral catch elements or projections at the base member 42 that engage into the gaps 40 on both sides and thus adjust the base member and, thus, the dog pins 32. Or it is conceivable to arrange the dog pins 32 themselves directly in the belt 26 without the base member dependent on the tooth division.

The dog pins 32 (pins) are of metal which are cast into the base member 42 of the clamp with an injection mold. The injection mold cannot be fabricated with an arbitrarily exact tolerance. This means that the metal pins 32 cannot be cast in the base member 42 of the pin clamp exactly centrally in the X-plan and Y-plane.

So that the pin clamps 38 are always mounted on the belt 26 with the same error position, the base member 42 of the clamp has a recess 48 at the one side and a centering or mounting nose 49 (FIG. 7) at the other side. The base member 42 of the clamps can thus only be mounted in the proper attitude on the toothed belt 26. The centering nose 49 of the one clamp only fits into the recess 48 of the neighboring clamp.

Division errors of the dog pins that are caused by tolerances of the injection mold are thus avoided.

A further function of the clamp recess is as follows: the pins clamps 38 must lie as close as possible to one another in order to prevent an elasticity of the clamping in the toothed belt gap 40 from taking effect.

Figure 7:
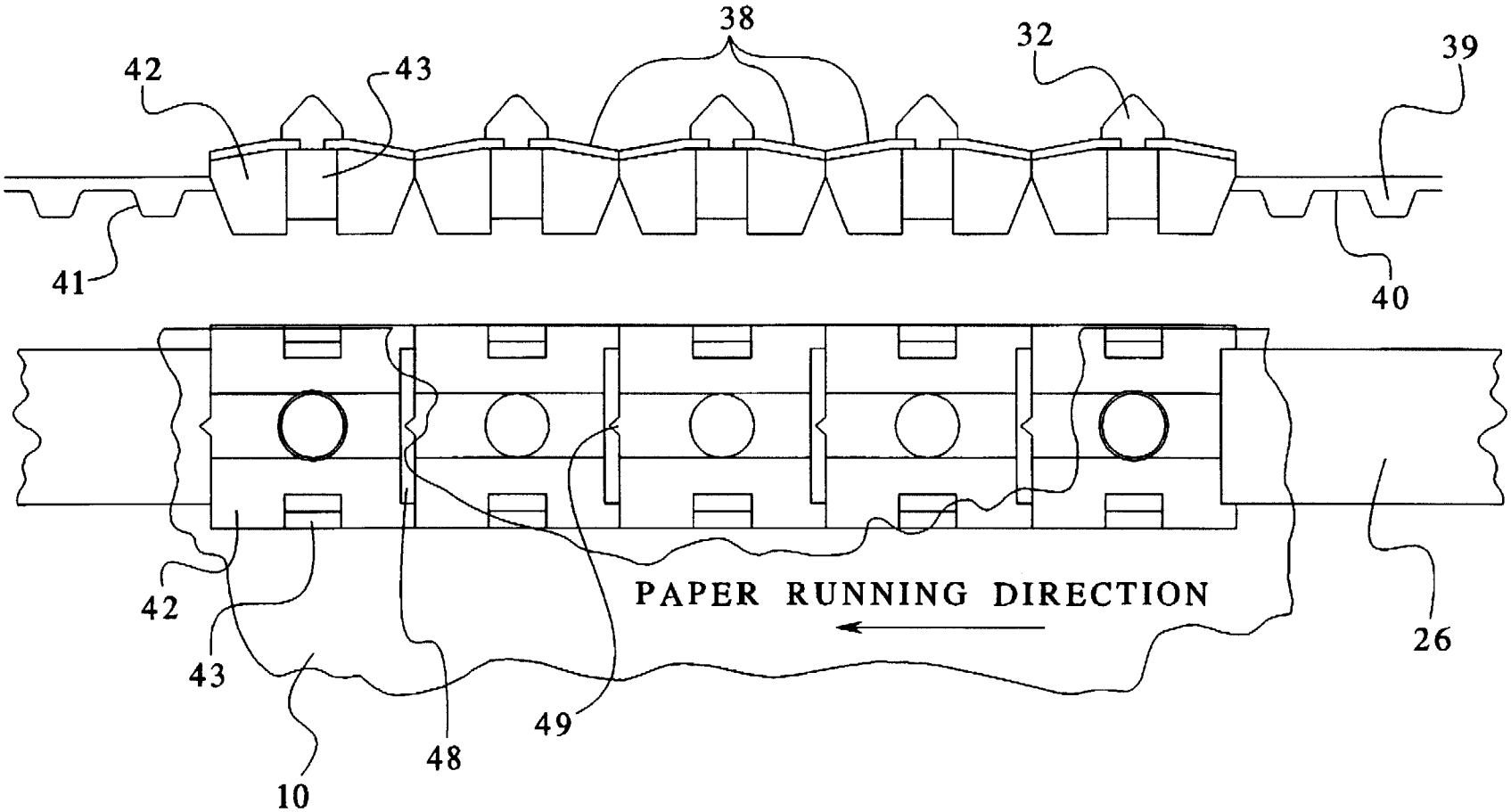
FIGS. 7*a* and 7*b* are schematic illustrations in side view and in plan view of a toothed belt with pin clamps arranged centrally thereon.

If the base member 42 of the clamps were to lie against one another with their full length, then paper dust would be pressed between the clamps. Damage to the clamps and positional errors would result. As a result of the clamp recess 48, the clamps 38 only lie against one another on a very short base via webs 50 in the edge regions; the middle region is free (FIG. 7). Paper dust and other dirt can thus fall out between the clamps 38 unpressed.

As can be seen from FIGS. 8, 9 and, in particular, 10, the paper web 10, given parallel (cylindrical) guide surfaces (collars 33) of the dog pins 32, can migrate up at these guide surfaces against the feed crawler cover 51 and thus produce positional errors of the paper transport holes 31 relative to the dog pins 32. Positioning errors of the toner image on the paper web during transfer printing result.

Figure 10:
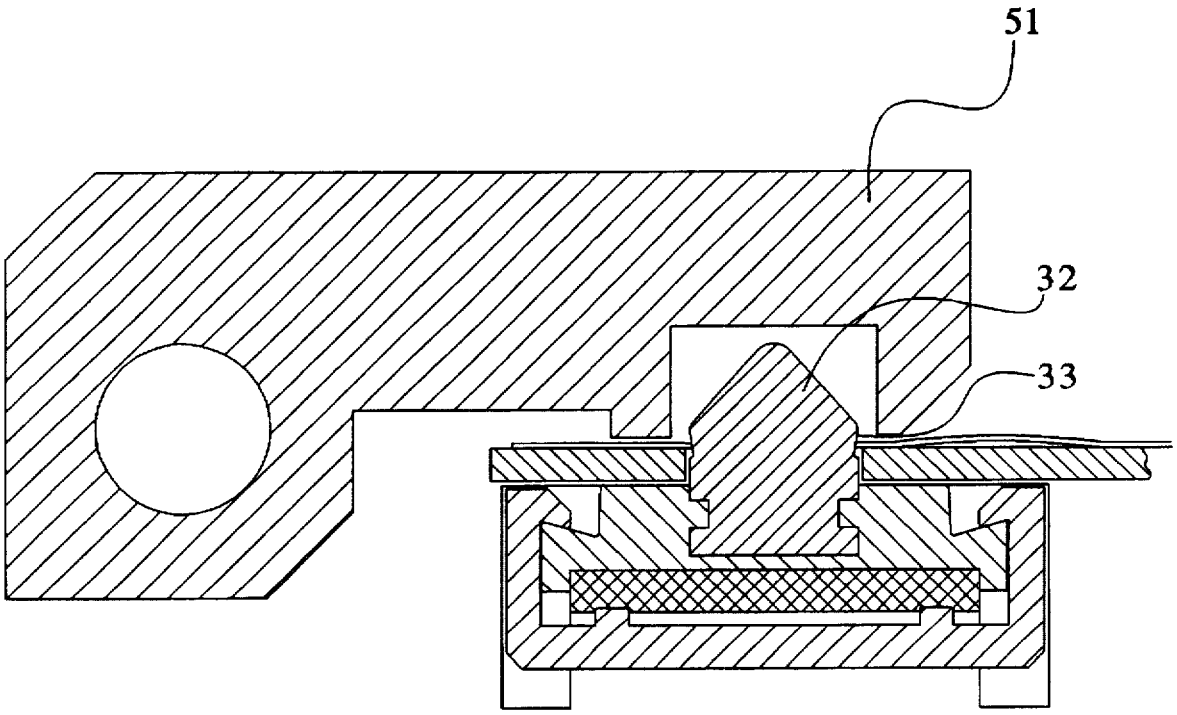
FIG. 10 is a schematic enlarged crossectional view of a tractor drive with centrally arranged pin clamps and dog pins with conical collar.
Figure 11:
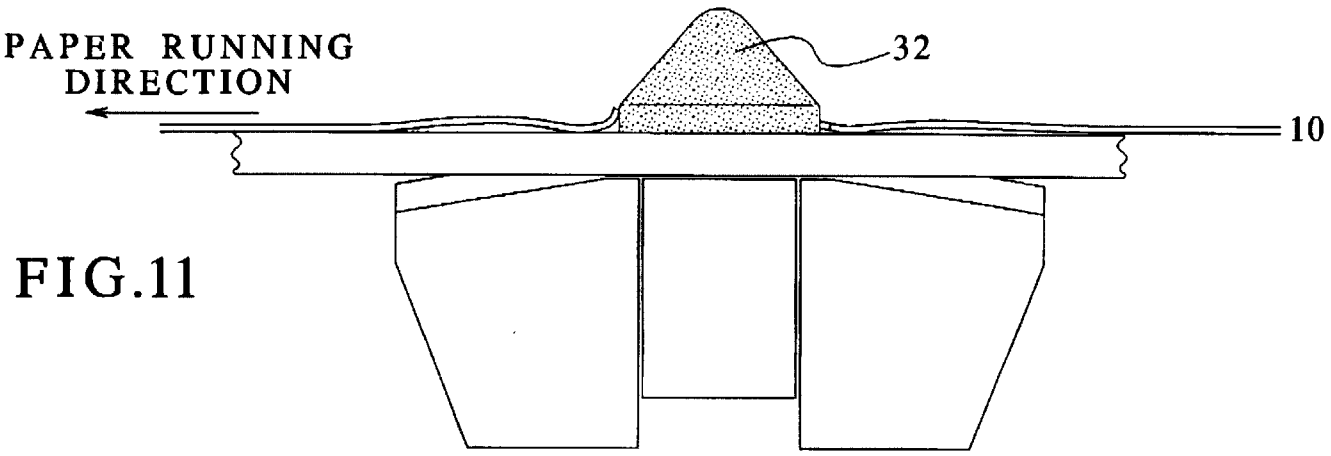
FIG. 11 is a schematic side illustration of the arching of the recording medium in the region of the margin perforations given the employment of dog pins with cylindrical collar.
Figure 12:
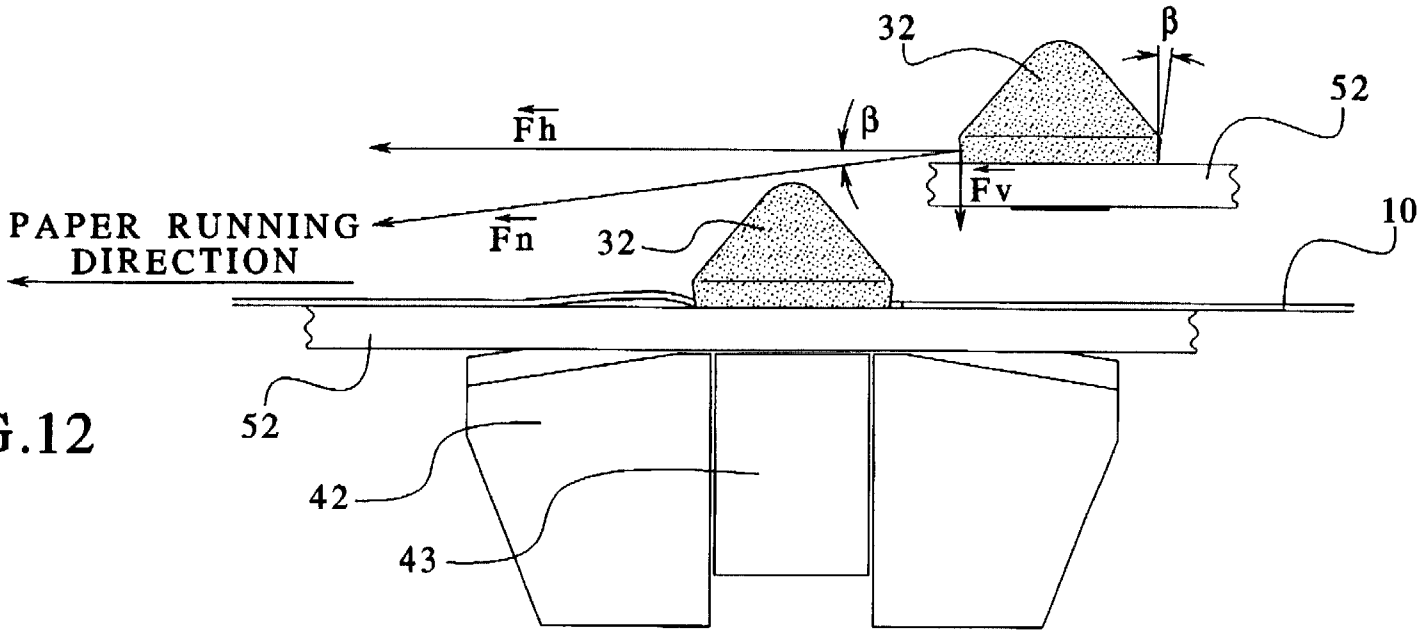
FIG. 12 is a schematic side illustration of the forces in the region of the margin perforations of the recording medium given a tractor drive having centrally arranged pin clamps and dog pins with conical collar.
Figure 13:
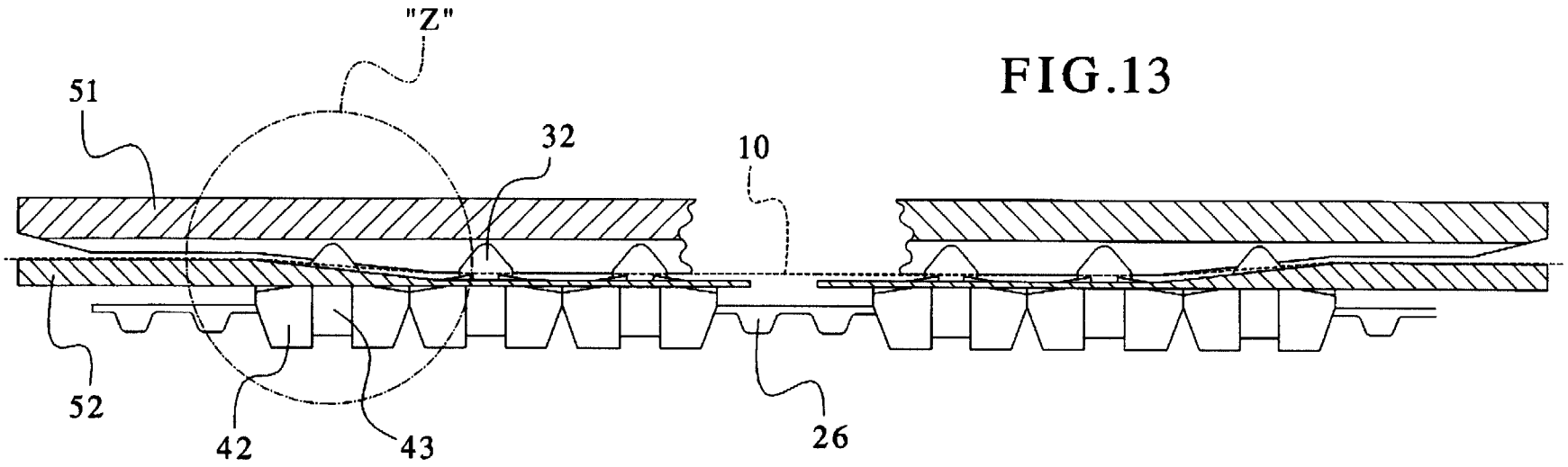
FIG. 13 is a schematic crossectional view of a tractor drive in the paper-conveying direction with a ramp-shaped paper baffle that lifts the recording medium up in the region of the pulleys.

A conical embodiment of the pin guide surfaces (collars 33) provides an alleviation (FIGS. 10, 12). The guide surfaces 33 must be so conical that the conveying force of the paper web 10 generates a force component that acts against the seating surface 52 (paper baffles) of the paper web 10. The paper web 10 can thus not migrate up against the feed crawler cover 51. A positionally exact paper web guidance during transport and a more stable paper running are thus achieved.

The following thereby applies for the force relationships shown in FIG. 12:

$$\underline{F}_n - \underline{F}_h = \underline{F}_v$$

$$F_v = i\ F_h \times \tan\beta$$

Whereby:

$\underline{F}_h$:transport force for the paper web 10

$\underline{F}_n$:normal force component perpendicular to the guide surface (collar surface) 33

$\underline{F}_v$:vertical force component of the paper web against the paper baffle 52

$\beta$:pin plane angle (guide plane angle).

The described clamp design is of considerable advantage given a continuous stock duplex data printer having two recording medium webs E1 and E2 lying side by side in close proximity in parallel mode, as shown in FIG. 1. With the inventive clamp design, two paper webs E1 and E2 running side-by-side can thus be operated minimally close to one another. Given this clamp design, however, it is beneficial to lift the paper web before the pins disengage or, respectively, engage from or, respectively, into the transport holes so that the transport holes 31 are prevented from being torn out. The lifting of the paper web can be achieved by an appropriate ramp shape of the paper baffle 52 according to the illustration of FIG. 13, analogous to that described in conjunction with FIG. 5.

Figure 14:
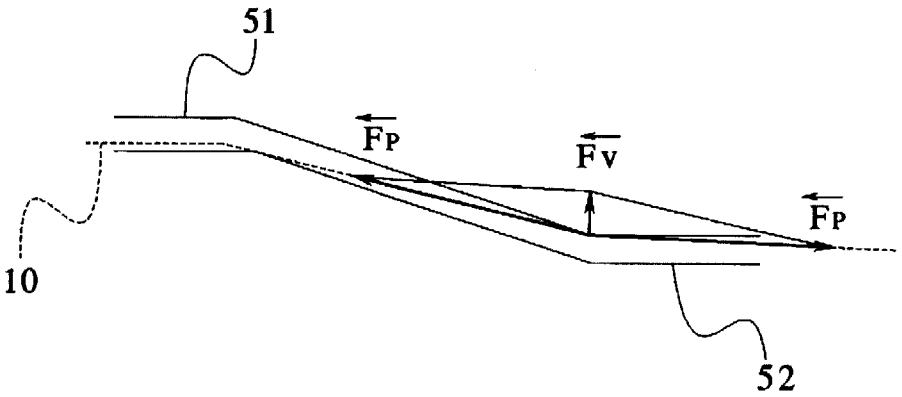
FIG. 14 is a schematic illustration of the forces in the region of the detail "Z" of the tractor drive of FIG. 13.

According to the illustration of FIG. 14, however, this shaping of the paper baffle—given a paper traction force $\underline{F}_p$—generates a force component $\underline{F}_v$ in the paper web that presses it against the feed crawler cover 51. Paper running problems and line alignment errors of the print format result.

The conical guide surface shape of the dog pins likewise prevents this disturbing effect that was just described.

Given the tractor drives (as disclosed in the German patent document DE-C2-3307583) employed in electrographic continuous printers, the dog pins are usually arranged in clamps that lie next to the belt. Since the paper web has a resistance to the conveying direction, the pin clamps are placed at a slant given this torque load. As a result thereof, the paper web—whose position is defined by the transport pins—deviates from the required rated position. The toner image is then transferred positionally offset onto the paper web in the transfer printing region. Line alignment errors are the result.

The inventive clamps 38 are implemented such that they lie centrally on the outside circumferential surfaces of the belts 26 (FIG. 7). A tilting moment can thus not occur. Since the clamps 38 cannot pitch, the position of the dog pins 32 is independent of transport load fluctuations of the paper web.

Due to the above-described pitching of the known transport clamps, the individual clamp is so highly loaded by the torque acting as a bending moment on the clamp member that occurs in case of a paper jam that the clamp can break.

The inventive clamp 38 has the dog pins 32 arranged such that these lie centrally on the conveyor belt 26. The force transmission from dog pin to conveyor belt thus ensues without a lever arm. As a result, no bending moment is transmitted onto the clamp. A risk of destroying the transport clamps in a case of a paper jam is thus no longer present.

Although other modifications and changes may be suggested by those skilled in the art, it is the intention of the inventors to embody within the patent warranted hereon all changes and modifications as reasonably and properly come within the scope of their contribution to the art.

We claim:

1. A transfer printing station for a high speed electrographic printer or copier device, comprising:

an intermediate carrier for transfering toner images to a recording medium;

a charging corotron for charging said intermediate carrier;

a character generator for character generation on said intermediate carrier;

a transfer printing saddle, two recording medium webs having margin perforations conducted over said transfer printing saddle in close proximity next to one another, a conveyor means for parallel transporting of the two recording medium webs at least in a region of a transfer printing saddle, toothed belts respectively allocated to the margin perforations of the recording medium webs, axially spaced, motor-driven toothed disks over which said toothed belts are guided, and dog pins centrally secured on an outside circumferential surface of the toothed belts, said dog pins including a collar with guide surfaces which is adjoined by a tapering head part and that engage into the margin perforations up to the collar in a conveying path lying between the toothed disks and convey the two parallel recording medium webs, whereby, for achieving a high line alignment precision, the toothed belts include transport teeth on their inside circumferential surface that are arranged in a predetermined tooth division based on the spacing of the margin perforations of the recording medium webs having a division error from tooth to tooth or, respectively, gap to gap that is a fraction of a required line alignment precision and comprise dog pins mounted on their outside circumferential surface dependent on the tooth division of the transport teeth.

2. A transfer printing station according to claim 1, wherein said dog pins are respectively arranged in a base member on the outside circumferential surface of the toothed belt, whereby the base member has an adjustment element allocated to it that engages into gaps limited by tooth profiles of the transport teeth and thus adjusts the base member.

3. A transfer printing station according to claim 2, further comprising:

an adjustment element that is fashioned as a catch element latched to the base member.

4. A transfer printing station according to claim 2, further comprising:

an adjustment element attacking at the tooth profiles of the transport teeth via adjustment bevels.

5. A transfer printing station according to claim 3, whereby the catch element includes a clamp web that is guided by a gap and has seating ridges that are arranged such that the catch element supports itself line-shaped with maximum base in the gap.

6. A transfer printing station according to claim 1, further comprising:

a base member that accepts the dog pins and that comprises spacer webs to a base member at at least one side in the contacting region to a base member lying alongside.

7. A transfer printing station according to claim 1, further comprising:

base members that accept the dog pins and that comprise positioning means that are fashioned such that the base members can only be arranged on the toothed belt in a defined integration position next to one another.

8. A transfer printing station according to claim 7, further comprising:

base member that accept the dog pins and that comprise a recess on the one side and a mounting nose on the other side in the contacting region to the base members lying alongside.

9. A transfer printing station according to claim 1, wherein said dog pins include a collar with conical guide surfaces tapering in the direction of a seating surface for the recording medium, a head part adjoining said collar, whereby the dog pins engage into the margin perforations of the recording medium up into the region of their collars upon transport of the recording medium, and the guide surfaces generate a force component in the contact region to the recording medium that presses the recording medium against the seating surface.

10. A transfer printing station according to claim 1, further comprising:

at least one pulley over which the toothed belt is conducted, a recording medium positioning device arranged in a region of the pulley that guides the recording medium upon engagement and disengagement of the dog pins during rotation of the pulley in a region of a head part of the dog pins such that the margin perforations are not deformed.

11. A transfer printing station according to claim 10, further comprising:

a guide element that lifts the recording medium in the region of the pulley.

12. A transfer printing station according to claim 10, further comprising:

a supporting means that supports the toothed belt in a conveying region between the pulleys and that has allocated hold-down elements for the recording medium.

* * * * *